US008138863B2

(12) United States Patent
Tanaka et al.

(10) Patent No.: US 8,138,863 B2
(45) Date of Patent: Mar. 20, 2012

(54) ELECTROMAGNETIC RELAY

(75) Inventors: Hiroyasu Tanaka, Yamaga (JP); Ikuhiro Yoshihara, Yamaga (JP); Ryuichi Hashimoto, Yamaga (JP); Kazuchika Hiroki, Kumamoto (JP); Hideaki Tsuji, Yamaga (JP)

(73) Assignee: OMRON Corporation, Kyoto (JP)

( * ) Notice: Subject to any disclaimer, the term of this patent is extended or adjusted under 35 U.S.C. 154(b) by 150 days.

(21) Appl. No.: 12/489,850

(22) Filed: Jun. 23, 2009

(65) Prior Publication Data

US 2009/0322454 A1 Dec. 31, 2009

(30) Foreign Application Priority Data

Jun. 30, 2008 (JP) ..... 2008-170512

(51) Int. Cl.
*H01H 3/00* (2006.01)

(52) U.S. Cl. ..... 335/195; 335/126; 335/131; 335/185; 335/202; 335/78

(58) Field of Classification Search ..... 335/78–86, 335/124, 126, 128–132, 151, 154, 179, 185, 335/195–201, 202, 203, 220, 248, 281; 200/16, 200/243, 298–305; 218/13, 68–78, 118–126, 218/155–157
See application file for complete search history.

(56) References Cited

U.S. PATENT DOCUMENTS

| | | | | | |
|---|---|---|---|---|---|
| 2,575,060 | A * | 11/1951 | Matthias | 218/25 |
| 4,203,084 | A * | 5/1980 | Yamaguchi et al. | 335/202 |
| 4,513,270 | A * | 4/1985 | Belbel et al. | 335/195 |
| 4,737,750 | A * | 4/1988 | Prouty | 335/177 |
| 4,755,781 | A * | 7/1988 | Bogner | 335/131 |
| 4,782,315 | A * | 11/1988 | Bataille et al. | 335/234 |
| 5,394,128 | A * | 2/1995 | Perreira et al. | 335/126 |
| 5,546,061 | A * | 8/1996 | Okabayashi et al. | 335/78 |
| 5,892,194 | A * | 4/1999 | Uotome et al. | 218/68 |
| 6,911,884 | B2 * | 6/2005 | Uotome et al. | 335/132 |
| 7,852,178 | B2 * | 12/2010 | Bush et al. | 335/126 |
| 7,859,373 | B2 * | 12/2010 | Yamamoto et al. | 335/126 |
| 7,868,720 | B2 * | 1/2011 | Bush et al. | 335/151 |
| 2002/0158727 | A1 * | 10/2002 | Namen | 335/78 |
| 2004/0080389 | A1 * | 4/2004 | Nishida et al. | 335/132 |
| 2005/0011707 | A1 * | 1/2005 | Carriot | 188/171 |
| 2006/0050466 | A1 * | 3/2006 | Enomoto et al. | 361/160 |
| 2009/0096559 | A1 * | 4/2009 | Yano et al. | 335/187 |

FOREIGN PATENT DOCUMENTS

| | | | |
|---|---|---|---|
| JP | 60-163658 | U | 10/1985 |
| JP | 2006185816 | A * | 7/2006 |
| KR | 854381 | B1 * | 9/2008 |

* cited by examiner

*Primary Examiner* — Mohamad Musleh
(74) *Attorney, Agent, or Firm* — Osha • Liang LLP

(57) ABSTRACT

An electromagnetic relay has a movable contact arranged at one end of a drive shaft that reciprocates in an axis center direction based on excitation and demagnetization of an electromagnet block, and a pair of adjacently arranged fixed contacts with which the movable contact is operable to contact and separate. A first electromagnetic iron piece, a second electromagnetic iron piece and the movable contact are inserted to the drive shaft so that the first electromagnetic iron piece and the second electromagnetic iron piece sandwich the movable contact. The second electromagnetic iron piece is biased to one end side of the drive shaft with a coil spring inserted to the drive shaft. When the movable contact contacts to the pair of fixed contacts, the second electromagnetic iron piece forming a magnetic circuit with the first electromagnetic iron piece pushes the movable contact to the pair of fixed contacts.

10 Claims, 14 Drawing Sheets

ELECTROMAGNETIC RELAY

BACKGROUND OF THE INVENTION

1. Technical Field

The present invention relates to electromagnetic relays, and in particular, to a power load electromagnetic switch.

2. Related Art

Conventionally, in a power load electromagnetic switch, an electromagnetic repulsion acts between a fixed contact and a movable contact when an abnormal current flows in time of opening/closing of contact. The contact pressure thus lowers and the contact resistance becomes large thereby rapidly increasing the Joule heat or the contacts separate thereby generating an arc heat, whereby the movable contact and the fixed contact may be welded.

In order to prevent such welding of the contacts, there has been disclosed a movable contact supporting device of a switch in which a movable contact having an upper magnetic piece attached to an upper surface is arranged, so as to be slidable in the up and down direction by way of a pushing spring, in a window hole formed at a supporting board, and a lower magnetic piece is arranged, so as to be slidable in the up and down direction by way of a pushing spring, in a slide regulation hole formed at the lower side of the window hole with a wider than the width of the window hole so as to include a stopper at the upper part and the lower part (see Japanese Unexamined Utility Model Publication No. 60-163658).

More specifically, a movable contact 15 is sandwiched by two upper and lower magnetic pieces 13, 20, which are electromagnetic iron pieces, to resolve the drawback of electromagnetic repulsion, as shown in FIG. 4 of Japanese Unexamined Utility Model Publication No. 60-163658.

SUMMARY

However, in the electromagnetic relay described above, one upper magnetic piece 13 is biased to the movable contact 15 with a pushing spring 16, while the other lower magnetic piece 20 is biased to the movable contact 15 with a pushing spring 23, and thus the number of components and the number of assembly steps are great, and the structure is complicating.

The present invention has been devised to solve the problems described above, and an object thereof is to provide an electromagnetic relay capable of preventing drawbacks by electromagnetic repulsion, and having a small number of components and reducing the number of assembly steps, and having a simple structure.

In accordance with one aspect of the present invention, to achieve the above object, there is provided an electromagnetic relay for contacting and separating both ends of a movable contact arranged at one end of a drive shaft, which reciprocates in an axis center direction based on excitation and demagnetization of an electromagnet block, to a pair of adjacently arranged fixed contacts, wherein a first electromagnetic iron piece, a second electromagnetic iron piece and the movable contact are inserted to the drive shaft so that the first electromagnetic iron piece and the second electromagnetic iron piece sandwich the movable contact, wherein the second electromagnetic iron piece is biased to one end side of the drive shaft with a coil spring inserted to the drive shaft, and wherein when the movable contact contacts to the pair of fixed contacts, the second electromagnetic iron piece forming a magnetic circuit with the first electromagnetic iron piece pushes the movable contact to the pair of fixed contacts.

According to the present invention, since the second electromagnetic iron piece is biased to one end side of the drive shaft with one coil spring, two coil springs are not necessary as in the related art example. Thus, an electromagnetic relay capable of preventing drawbacks by electromagnetic repulsion, and having a small number of components and reducing the number of assembly steps, and having a simple structure can be obtained.

According to an embodiment of the present invention, an upper end face of the second electromagnetic iron piece, which reciprocates, having a substantially U-shaped cross section contact and separate to and from a lower surface of the first electromagnetic iron piece of plate-shape.

According to the present embodiment, an electromagnetic relay capable of preventing drawbacks by electromagnetic repulsion, and having a small number of components and reducing the number of assembly steps, and having a simple structure can be obtained by having the upper end face of the second electromagnetic iron piece having a substantially U-shaped cross section contact and separate to and from the lower surface of the plate-shaped first electromagnetic iron piece.

According to another embodiment of the present invention, both ends of the first electromagnetic iron piece may slidably contact opposing inner side surfaces of the second electromagnetic iron piece, which reciprocates, having a substantially U-shaped cross section.

According to the present embodiment, since both ends of the first electromagnetic iron piece slidably move on the opposing inner side surface of the second electromagnetic iron piece at the initial stage of the operation of the drive shaft, the magnetic resistance is small, large attractive force is obtained, and welding of the movable contact is reliably regulated.

According to still another embodiment of the present invention, both the first and the second electromagnetic iron pieces may have a substantially L-shaped cross section, a distal end face of a bent portion of one electromagnetic iron piece contacting and separating a flat surface of the other electromagnetic iron piece.

According to the present embodiment, the parts can be commoditized and the part management can be facilitated since the first and second electromagnetic iron pieces have the same cross-sectional shape.

According to yet another embodiment of the present invention, both the first and the second electromagnetic iron pieces may have a substantially U-shaped cross section, distal end faces of bent portions contacting and separating each other.

According to the present embodiment, the parts can be commoditized and the part management can be facilitated since the first and second electromagnetic iron pieces have the same cross-sectional shape.

In particular, the contacting/separating surfaces of the first and second electromagnetic iron pieces having a substantially L-shaped cross section or having a substantially U-shaped cross section may be tapered surfaces that can contact or separate to and from each other.

According to the present embodiment, the attraction area increases and the magnetic resistance reduces thereby obtaining an electromagnetic relay of small power consumption.

DETAILED DESCRIPTION

Hereinafter, a power load electromagnetic relay serving as an embodiment applied with a contact device of the present invention will be described with reference to the accompanying drawings FIGS. 1A to 14. As shown in FIGS. 1A to 13, a power load electromagnetic relay according to a first embodiment, in brief, has a drive mechanism unit 20 and a contact mechanism unit 50, which are integrated one above the other, accommodated in a case 10, and a cover 70 fitted to cover the case 10.

Figure 4:
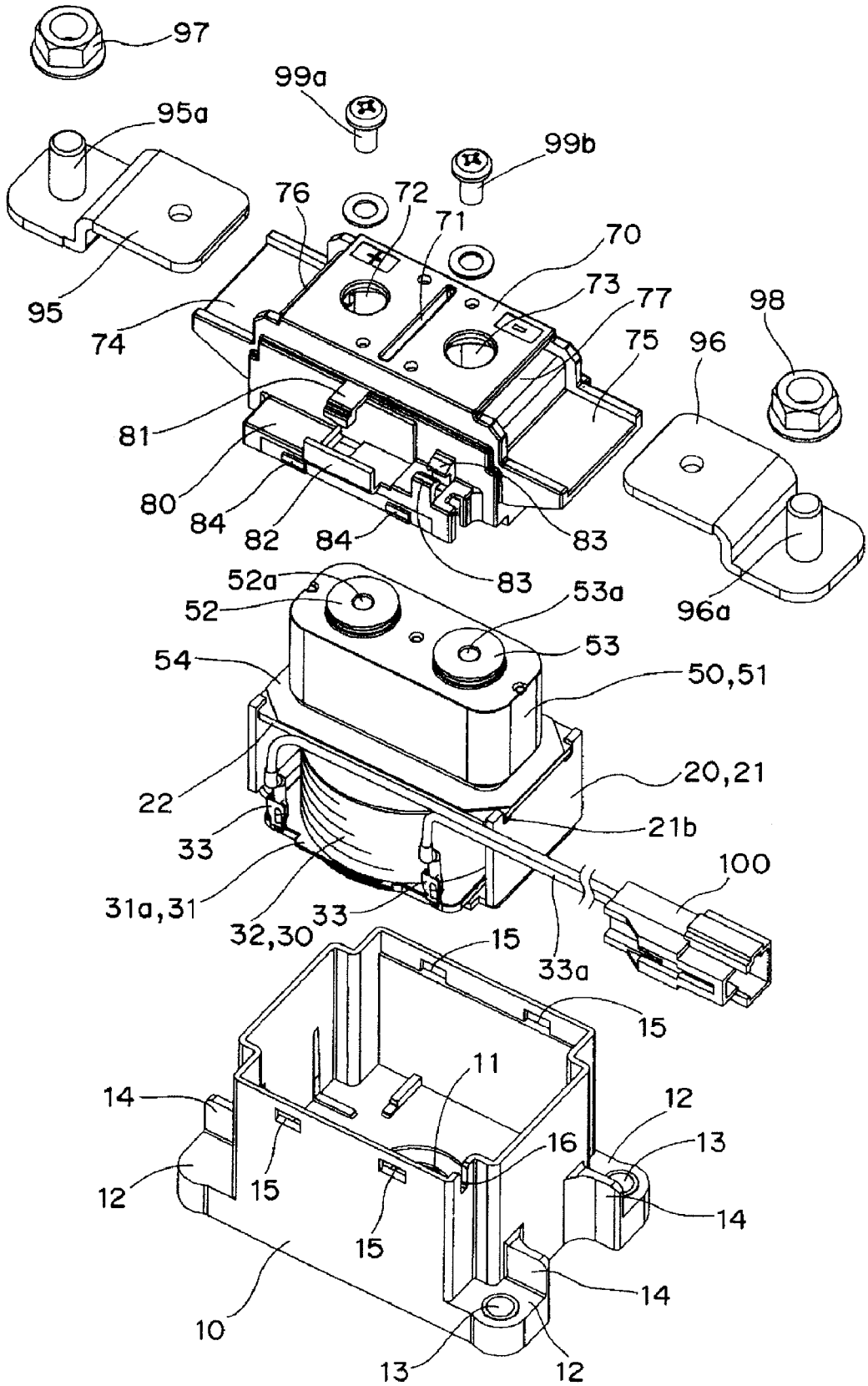
FIG. 4 is an exploded perspective view of the contact device shown in FIGS. 1A and 1B.

As shown in FIG. 4, the case 10 has a box-shape with a bottom surface capable of accommodating the drive mechanism unit 20, to be hereinafter described, where a fit-in recessed portion 11 (FIGS. 2 and 3) for positioning the drive mechanism unit 20 is formed at the middle of the bottom surface. The case 10 has an attachment hole 13 and a reinforcement rib 14 arranged in a projecting matter on a mount 12 arranged in a projecting matter towards the side from the lower edge of the outer peripheral corners. The attachment hole is not formed in one of the mount 12 to serve as a mark in time of attachment. Furthermore, the case 10 has an engagement hole 15 for preventing the cover 70, to be hereinafter described, from coming off formed at the opening edge of the opposing side walls.

Figure 5:
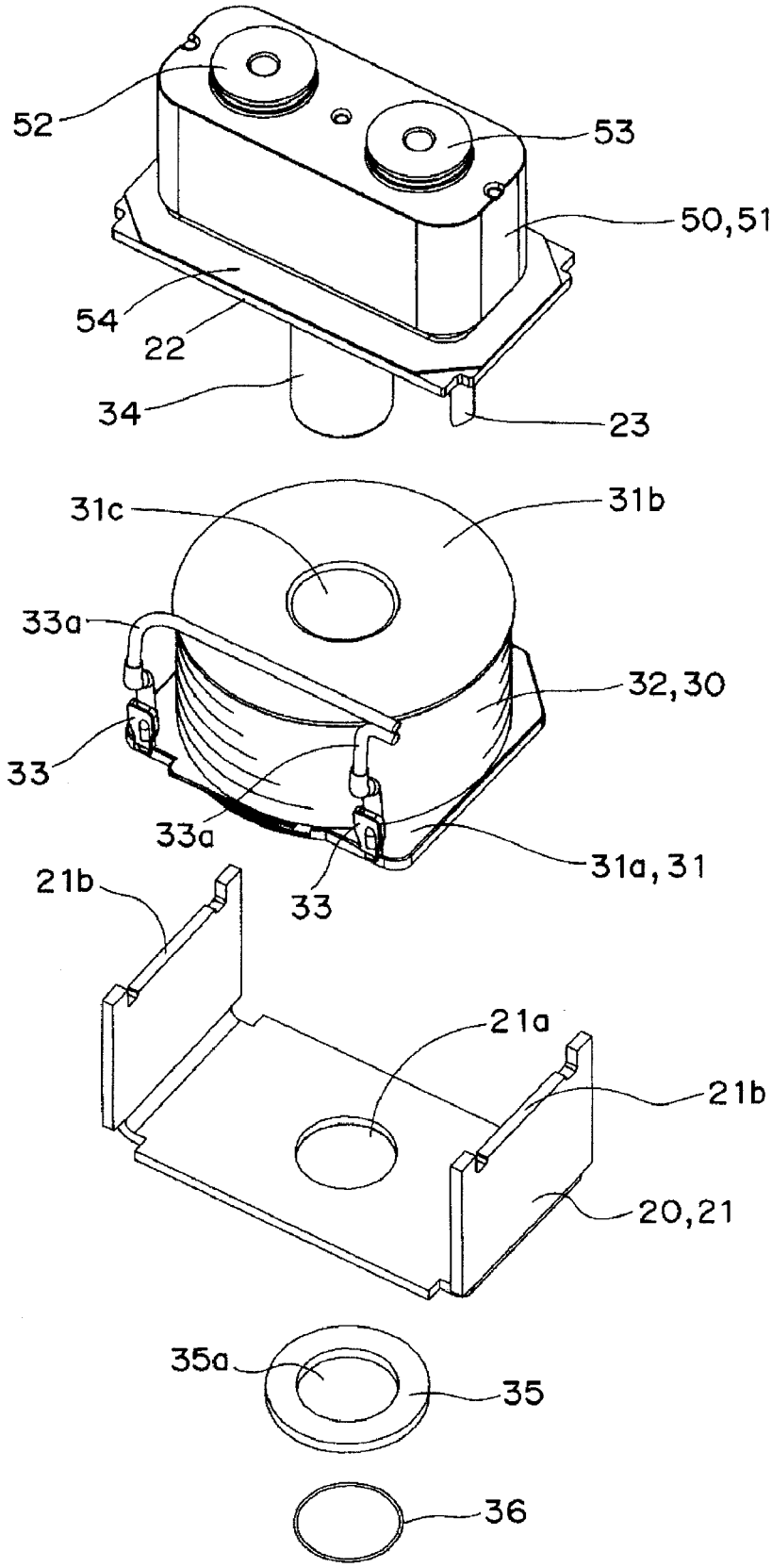
FIG. 5 is an exploded perspective view of the main parts of the contact device shown in FIGS. 1A and 1B.
Figure 6A:
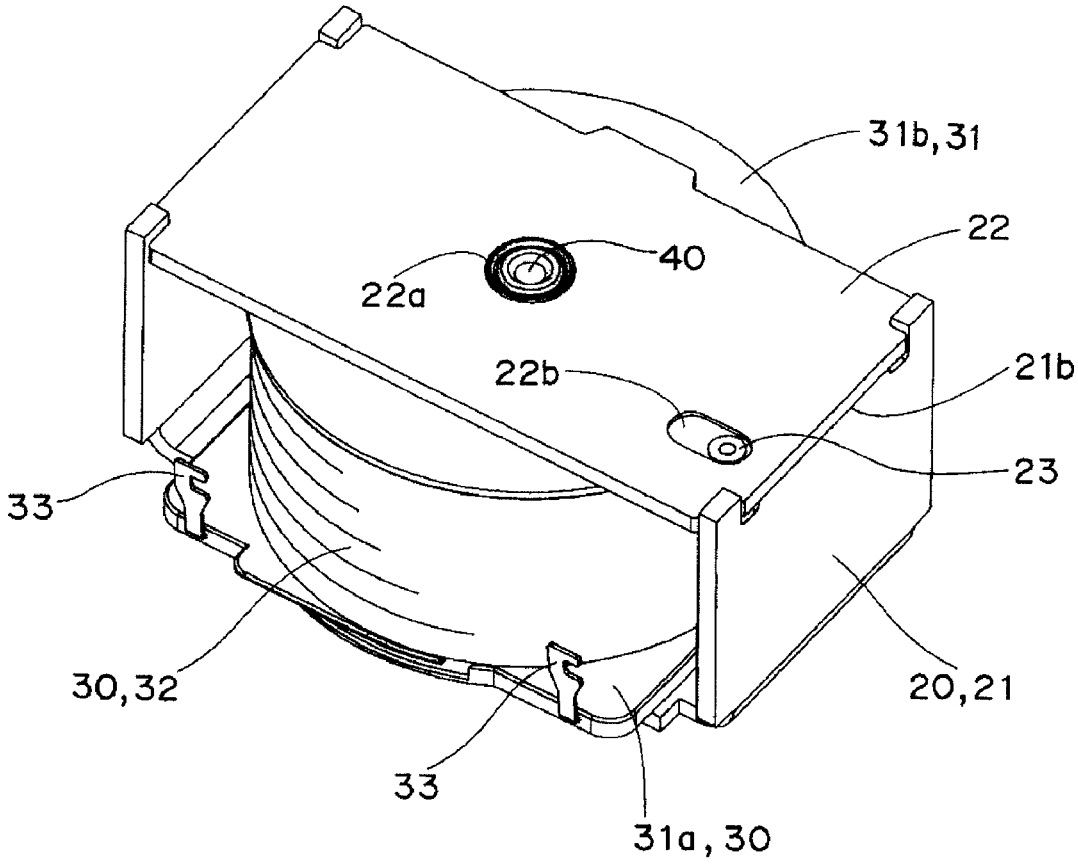
FIGS. 6A and 6B are a perspective view and a cross-sectional view, respectively, of a drive mechanism unit shown in FIG. 5.
Figure 6B:
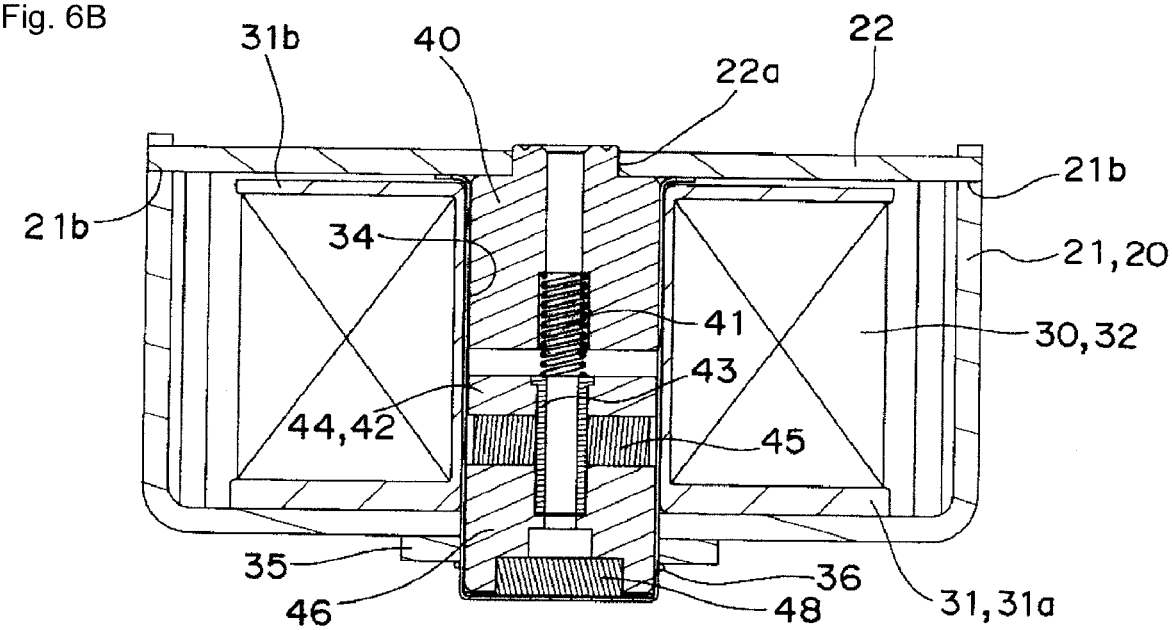
Figure 7:
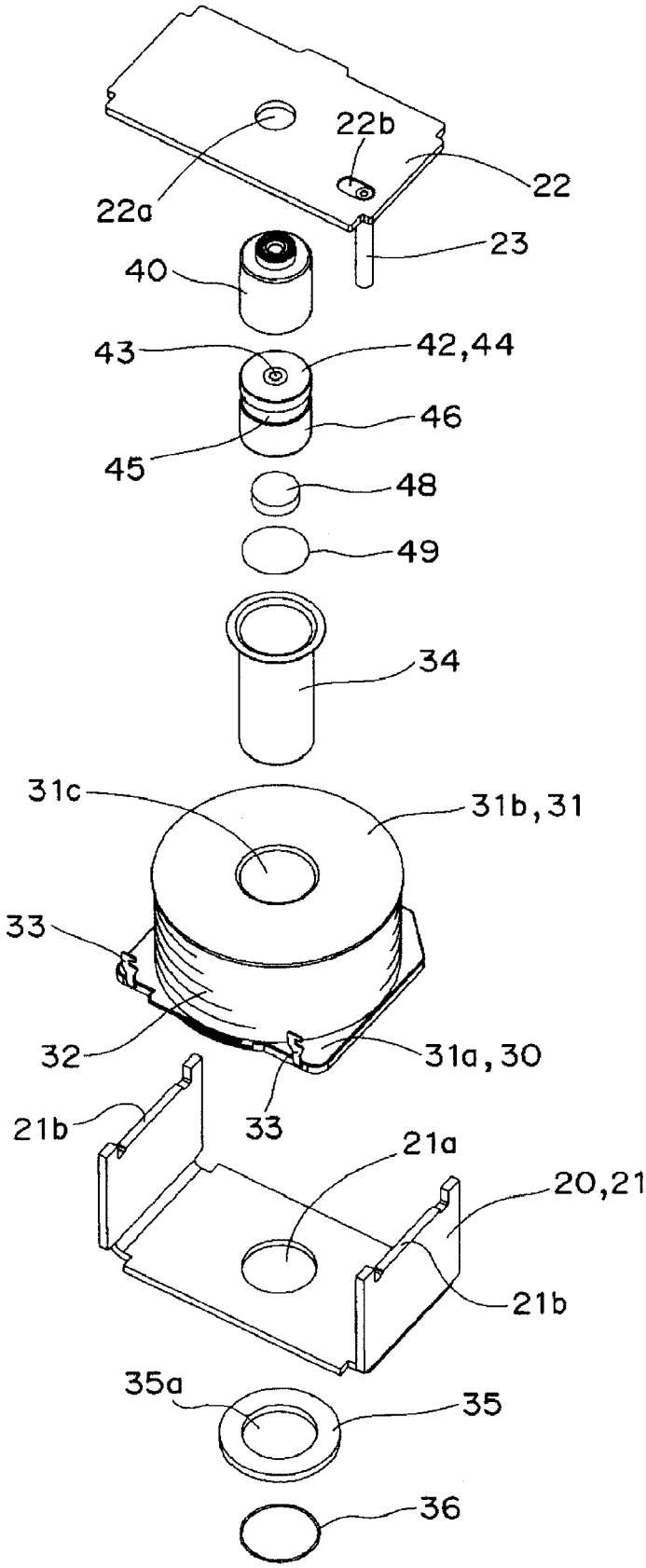
FIG. 7 is an exploded perspective view of the drive mechanism unit and a contact mechanism unit shown in FIG. 4.
Figure 8:
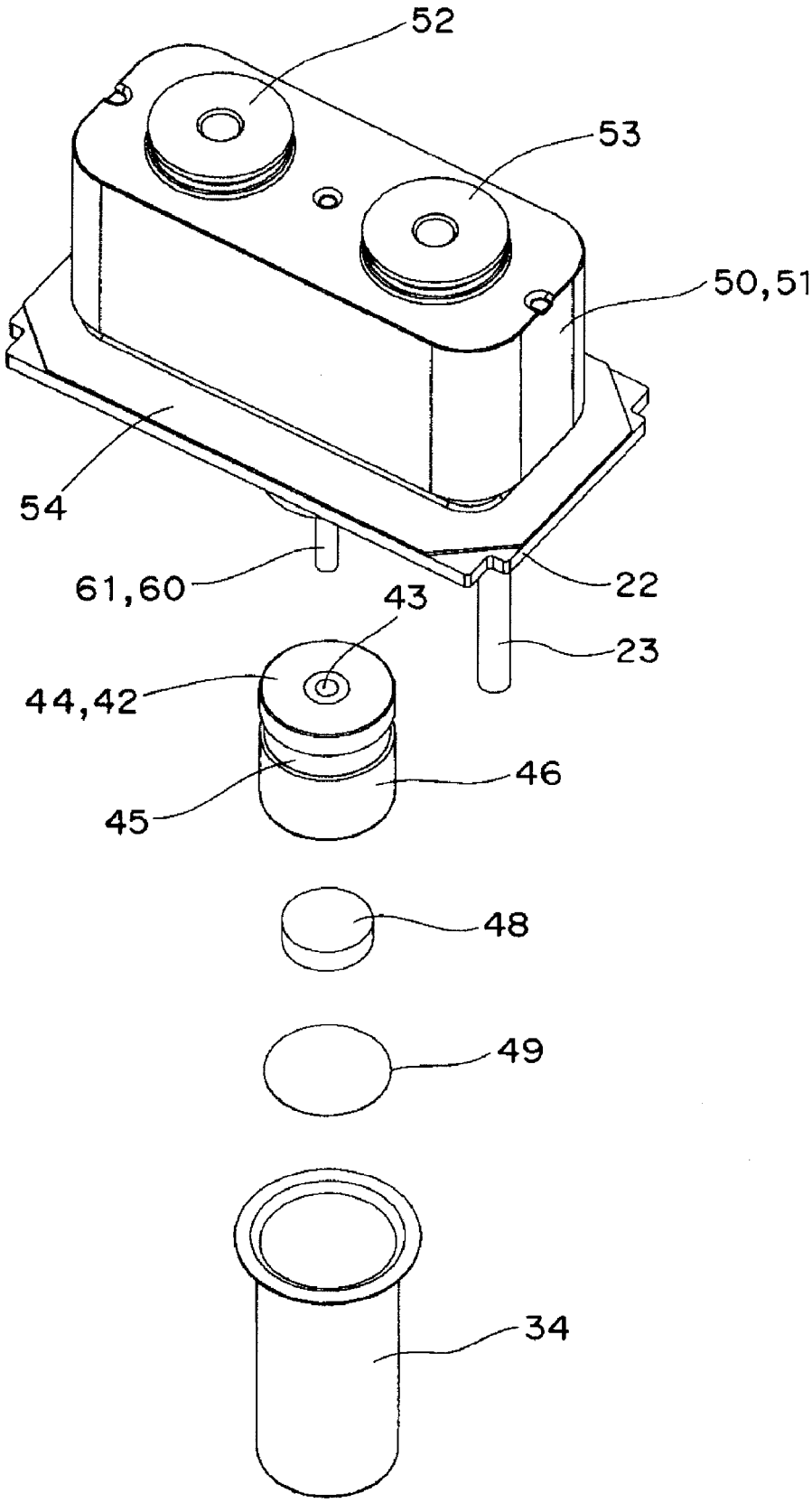
FIG. 8 is an exploded perspective view of the drive mechanism unit shown in FIG. 4.

As shown in FIGS. 5 to 7, the drive mechanism unit 20 has an electromagnet block 30, in which a coil 32 is wound around a spool 31, fixed between a first yoke 21 having a substantially U-shaped cross section and a second yoke 22 bridged over both ends of the first yoke 21.

As shown in FIG. 5, the first yoke 21 has an insertion hole 21*a* for inserting a bottomed tubular body 34, to be hereinafter described, formed at the middle of the bottom surface, and a cutout 21*b* for fitting the second yoke 22 formed at both ends.

As shown in FIG. 7, the second yoke 22 has both ends formed to a planar shape that can engage to and bridge over the cutouts 21*b* of the first yoke 21, and has a caulking hole 22*a* formed at the middle. The second yoke 22 has a counterbore hole 22*b* formed at the corner on the upper surface, where a gas sealing pipe 23 is air-tightly joined to the counterbore hole 22*b* by brazing.

As shown in FIGS. 5 and 7, the electromagnet block 30 is formed by wounding the coil 32 around the spool 31 having collar portions 31*a*, 31*b* at both ends, where a lead line of the coil 32 is engaged and soldered to relay terminals 33, 33 arranged at the collar portion 31*a*. Lead wires 33*a* are connected to the relay terminals 33, 33, respectively. As shown in FIGS. 5 and 6B, the bottomed tubular body 34 is inserted to a center hole 31*c* passing through the collar portions 31*a*, 31*b* of the spool 31. The upper opening of the bottomed tubular body 34 is air-tightly joined to the lower surface of the second yoke 22 by laser welding. The bottomed tubular body 34 has an annular auxiliary yoke 35 fitted to the lower end projecting out from the insertion hole 21*a* of the first yoke 21, and prevented from coming out with an O-ring 36. The O-ring 36 prevents the annular auxiliary yoke 35 from coming out and also functions to absorb sound and vibration.

According to the present embodiment, the opposing area of an outer circumferential surface of a movable iron core 42, to be hereinafter described, and the first yoke 21 and the annular auxiliary yoke 35 increases and the magnetic resistance reduces, and thus the magnetic efficiency improves and the power consumption reduces.

A shown in FIG. 6B, a fixed iron core 40, a returning coil spring 41, and the movable iron core 42 are sequentially accommodated in the bottomed tubular body 34. The fixed iron core 40 has the upper end caulked and fixed to the caulking hole 22*a* of the second yoke 22. Thus, the movable iron core 42 is biased to the lower side with the spring force of the returning coil spring 41 and a shock eliminating circular plate 48 made of rubber is attached to a recessed portion formed at the bottom surface. Furthermore, the bottomed tubular body 34 has an adhesion prevention metal sheet 49 accommodated between the inner bottom surface and the shock eliminating circular plate 48 made of rubber, as shown in FIG. 7.

As shown in FIG. 6B, the movable iron core 42 has a shaft hole with an inner diameter for receiving a drive shaft 61, to be hereinafter described, and is formed by inserting and integrating an upper movable iron core 44, a ring-shaped magnet 45, and a lower movable iron core 46 to a connection pipe 43 made of non-magnetic material. The desired magnetic circuit can be formed by shielding the magnetic force of the ring-shaped magnet 45 with the connection pipe 43.

Figure 9:
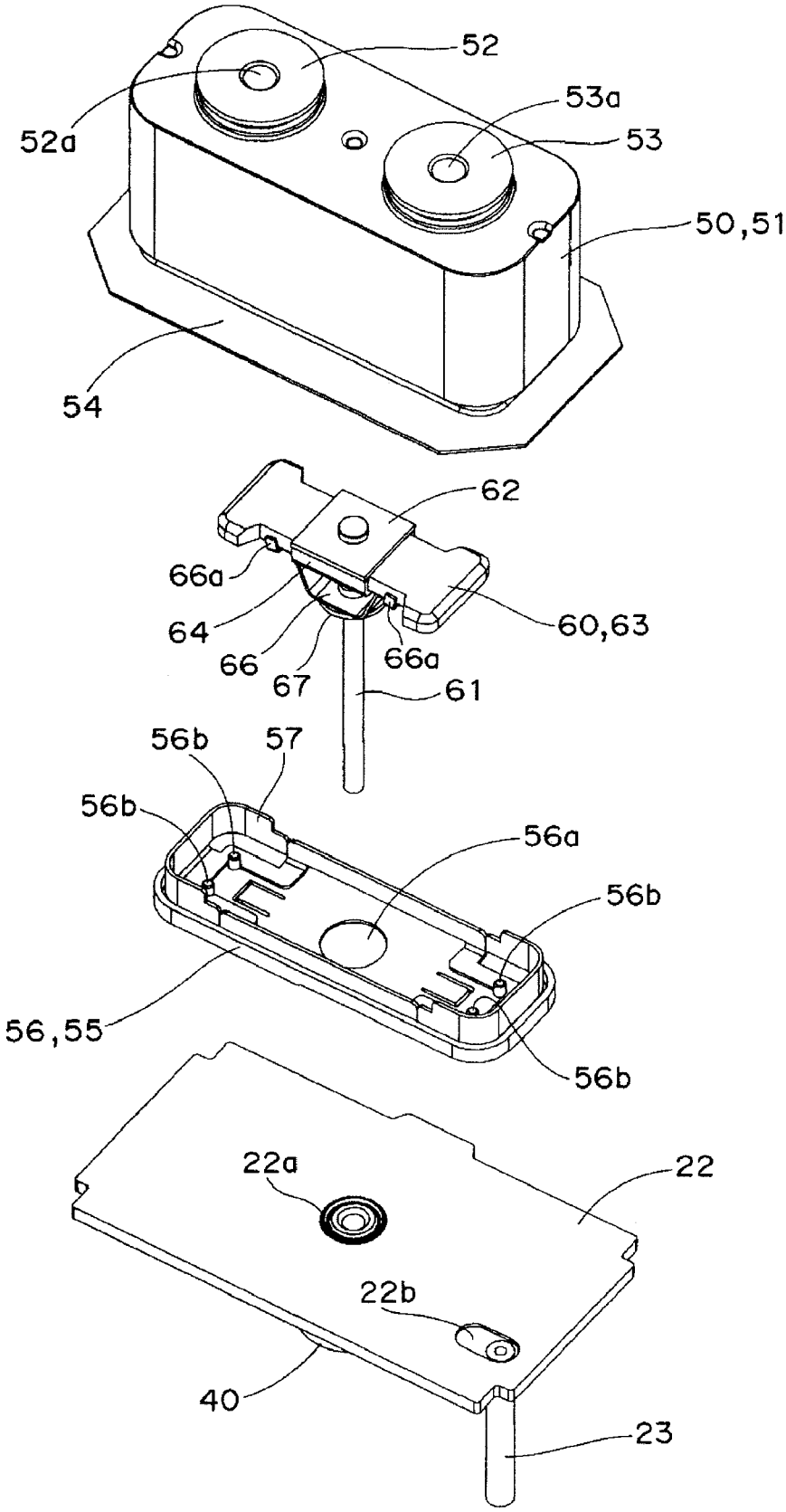
FIG. 9 is an exploded perspective view of the contact mechanism unit shown in FIG. 8.

As shown in FIG. 9, the contact mechanism unit 50 has a shield member 55 and a movable contact block 60 arranged in a sealed space formed by connecting and integrating a ceramic sealed container 51 to the upper surface of the second yoke 22.

The sealed container 51 has a pair of fixed contact terminals 52, 53 having a substantially T-shaped cross section brazed to the roof surface thereof, and a connection annular skirt portion 54 brazed to the lower opening edge. Screw holes 52*a*, 53*a* are formed at the upper surface of the fixed contact terminals 52, 53, respectively. The annular skirt portion 54 is positioned on the upper surface of the second yoke 22, and then welded and integrated by laser to thereby form the sealed space.

The shield member 55 is integrated by fitting a metal shield ring 57 to a box-shaped resin molded article 56 having a shallow bottom with a pass-through hole 56*a* at the middle, and caulking a caulking projection 56*b* arranged in a projecting manner at the bottom surface of the box-shaped resin molded article 56. The metal shield ring 57 draws the arc generated in time of contact opening/closing, and prevents the brazed part of the sealed container 51 from melting.

Figure 10:
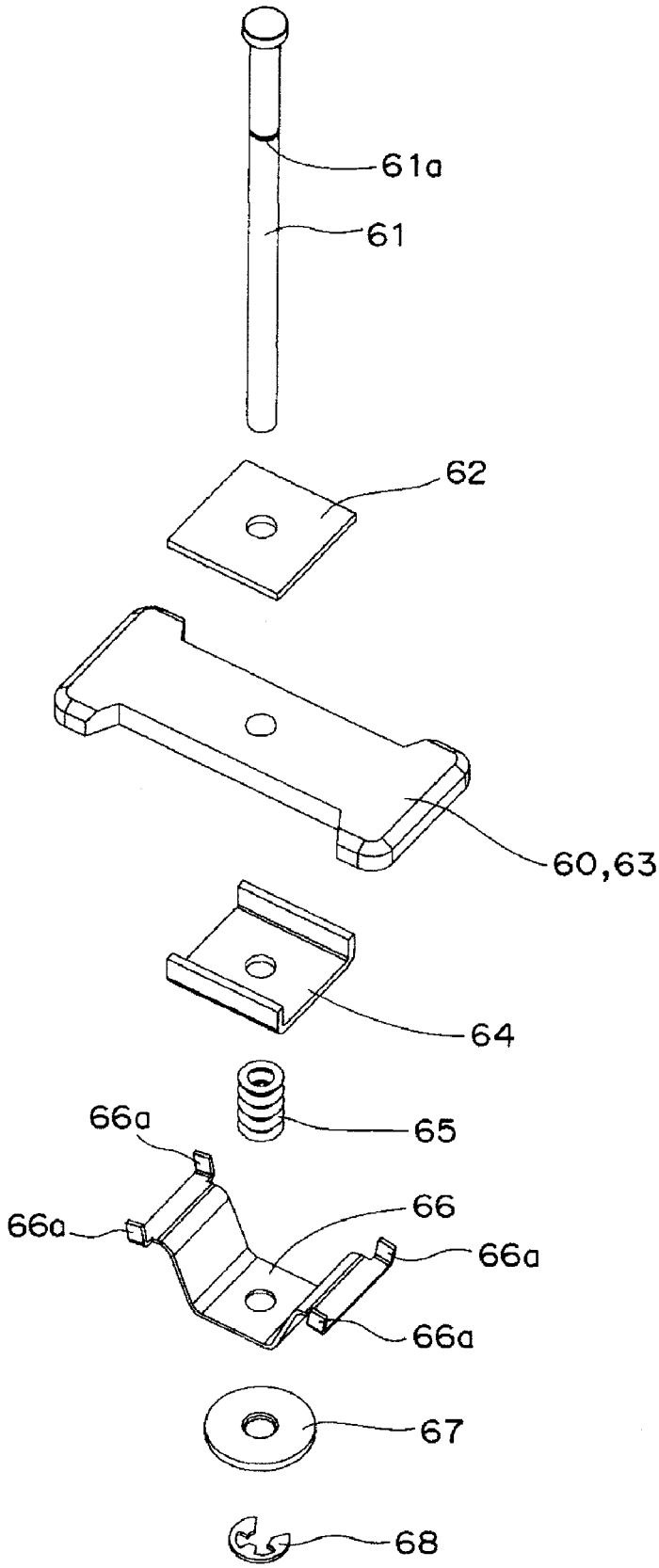
FIG. 10 is an exploded perspective view of a movable contact block shown in FIG. 9.

As shown in FIG. 10, the movable contact block 60 is assembled by sequentially inserting a plate-shaped first electromagnetic iron piece 62, a movable contact 63, a second electromagnetic iron piece 64 having a substantially U-shaped cross section, a contact-pressure coil spring 65, a contact-pressure plate spring 66 having a substantially V-shaped cross section, and a washer 67 to the drive shaft 61 having a substantially T-shaped cross section, and then engaging an E-ring 68 to an annular groove 61*a* formed on the outer circumferential surface of the drive shaft 61. In particular, the first electromagnetic iron piece 62, the movable contact 63, and the second electromagnetic iron piece 64 are biased upward through the contact-pressure coil spring 65. A slight gap consequently forms between the lower surface of the movable contact 63, and both ends of the contact-pressure plate spring 66 so that time-lag creates in time of operation.

The plate spring 66 has a pair of position regulating lock nails 66*a*, 66*a*, which lock with both side edges of the movable contact 63, respectively, formed at both ends. Thus, the position regulating lock nails 66*a* of the plate spring 66 lock to and accurately push both side edges of the movable contact 63, whereby an electromagnetic relay in which the variation of the operation characteristics is small is obtained.

A repulsive force arises between the fixed contact terminals 52, 53 and the movable contact 63 by the large current that flows when both ends of the movable contact 63 contact the fixed contact terminals 52, 53. However, the first and second electromagnetic iron pieces 62, 64 of the movable contact block 60 generate magnetic force for attracting each other based on the large current described above to thereby regulate the operation the movable contact 63 moves away from the fixed contact terminals 52, 53, and to prevent the contact welding due to generation of the arc.

Figure 11A:
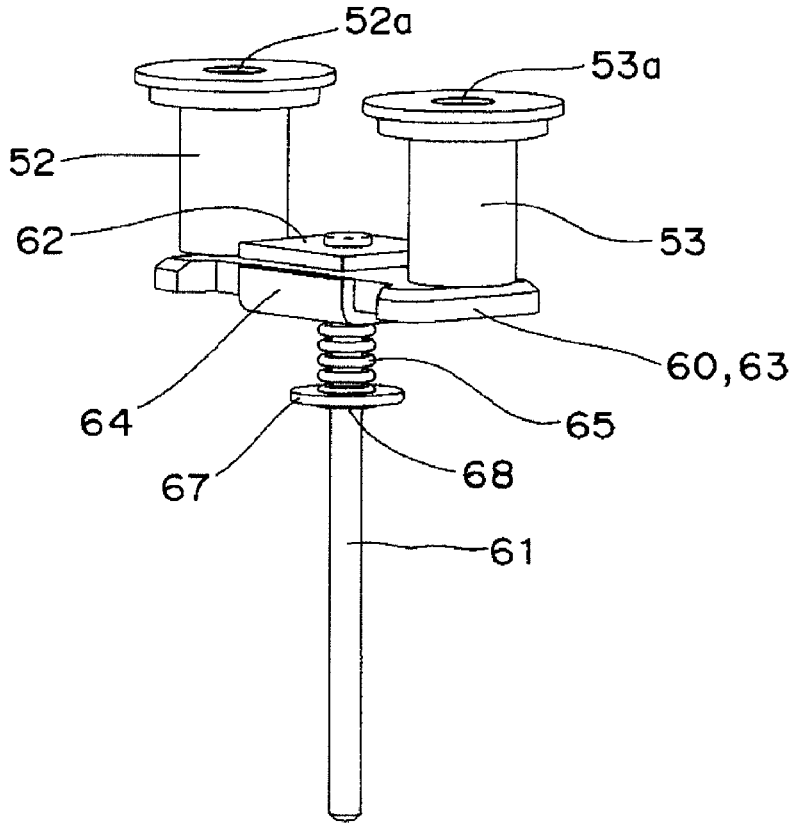
FIG. 11A is a perspective view of the main parts of the movable contact block.
Figure 11B:
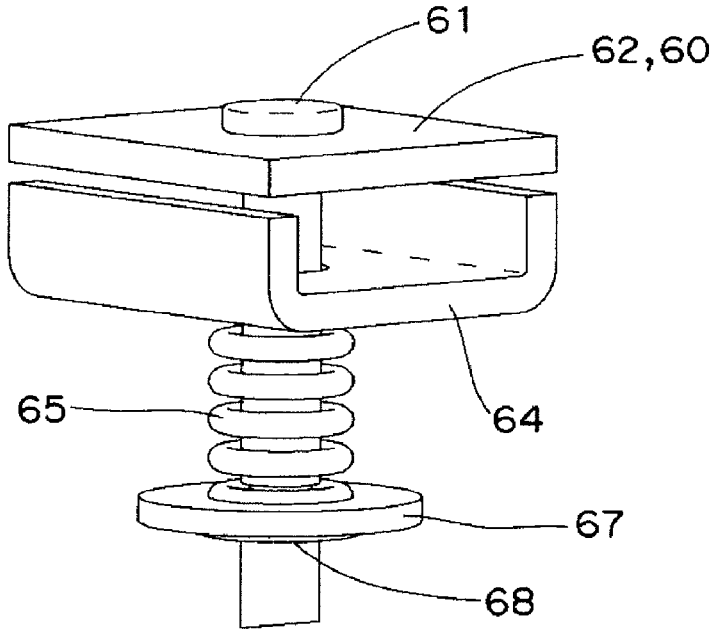
FIG. 11B is an enlarged perspective view of the main parts of FIG. 11A.

The first and second electromagnetic iron pieces 62, 64 of the movable contact block 60 according to the first embodiment have structures such that both ends of the first electromagnetic iron piece 62 contact the upper surface of both ends of the second electromagnetic iron piece 64, as shown in FIG. 11B. According to the present embodiment, when large current flows to the movable contact 63 at the initial stage in which the movable contact 63 is contacting the fixed contact terminals 52, 53, the first electromagnetic iron piece 62 and the second electromagnetic iron piece 64 attract each other, thereby pushing the movable contact 63 against the fixed contact terminals 52, 53. Thus, the movable contact 63 attracts to the fixed contact terminals 52, 53 without repelling against the fixed contact terminals 52, 53, whereby the arc does not create and contact welding does not occur.

The first and second electromagnetic iron pieces 62, 64 are not limited to the above embodiment, and may be configured as described in the embodiment shown in FIGS. 14A to 14D. For the sake of convenience of the explanation, the movable contact 63 and the contact-pressure plate spring 66 are not properly given in FIGS. 11A to 11B and 14A to 14D.

Figure 14A:
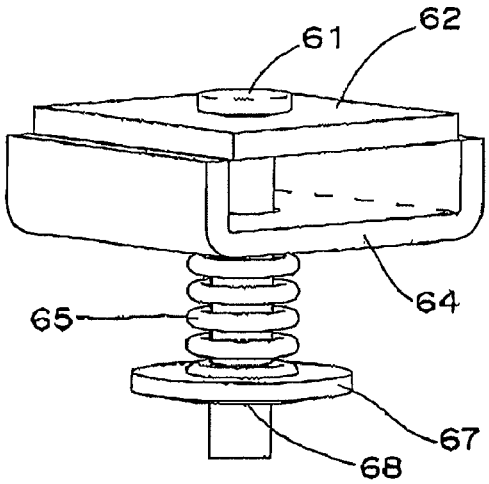
FIGS. 14A, 14B, 14C, and 14D are enlarged perspective views of the main parts of the movable contact block showing second, third, fourth, and fifth embodiments.

For example, as shown in FIG. 14A, both end faces of the first electromagnetic iron piece 62 may be adjacent to the opposing inner side surface of the second electromagnetic iron piece 64 having a substantially U-shaped cross section (second embodiment). According to the present embodiment, both end faces of the first electromagnetic iron piece 62 face the inner side surface of the second electromagnetic iron piece 64 at the initial stage in which the movable contact 63 is contacting the fixed contact terminals 52, 53. However, both end faces of the first electromagnetic iron piece 62 project out from both end faces of the second electromagnetic iron piece 64 at the stage the movable contact 63 contacts the fixed contact terminals 52, 53 with a predetermined pressure and the operation is completed. Thus, the magnetic resistance is small and large attractive force can be generated at the initial stage in which the movable contact 63 is contacting the fixed contact terminals 52, 53. As a result, the movable contact 63 is reliably regulated from separating from the fixed contact terminal 52, 53, and the contact welding is prevented.

Figure 14B:
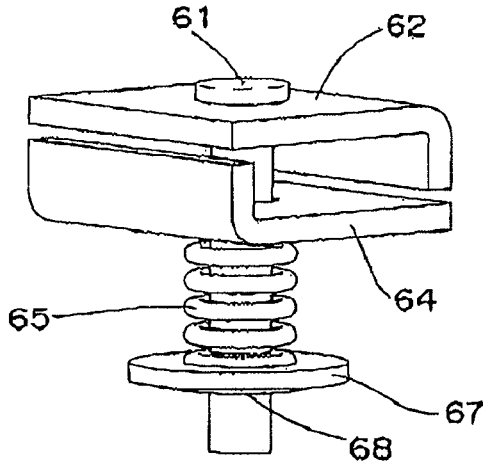

As shown in FIG. 14B, the first and second electromagnetic iron pieces 62, 64 having substantially L-shaped cross sections may be arranged to contact each other (third embodiment). According to the present embodiment, the parts can be commoditized since the first and second electromagnetic iron pieces 62, 64 have the same shape, which facilitates part management.

Figure 14C:
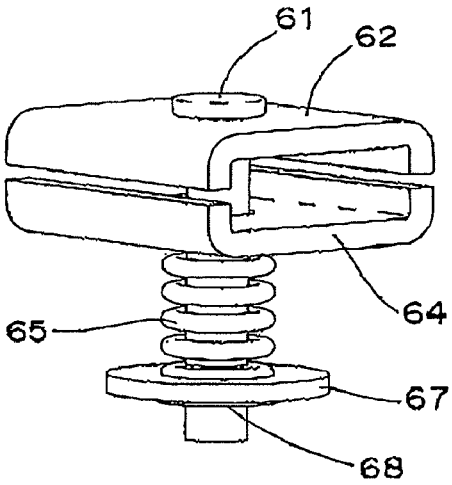

As shown in FIG. 14C, the first and second electromagnetic iron pieces 62, 64 having substantially U-shaped cross sections may be arranged such that perpendicular end faces thereof contact each other (fourth embodiment). According to the present embodiment, the parts can be commoditized similar to the second embodiment, which facilitates part management.

Figure 14D:
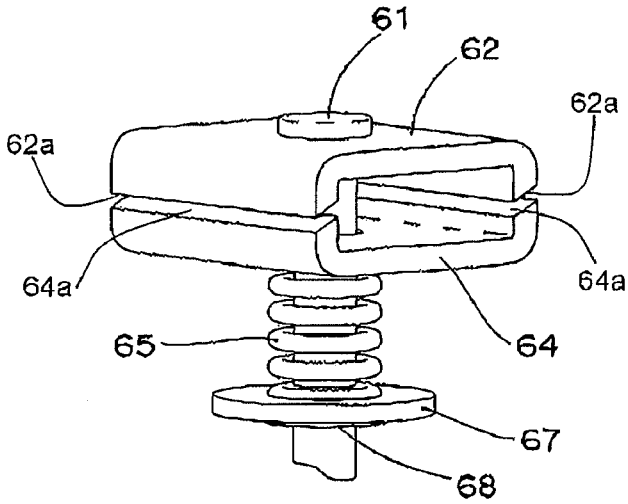

As shown in FIG. 14D, first and second electromagnetic iron pieces 62, 64 having substantially U-shaped cross sections may be arranged such that inclined end faces thereof contact each other (fifth embodiment). According to the present embodiment, the part management is facilitated, and furthermore, the opposing attraction area is large and the attractive force is large since the attracting distal end faces 62*a*, 64*a* are inclined surfaces.

The contact-pressure coil spring 65 and the plate spring 66 both provide a contact pressure to the movable contact 63. In the present embodiment, the adjustment of the attractive force characteristics is facilitated and the degree of freedom in design is extended by combining the contact-pressure coil spring 65 and the plate spring 66.

Figure 12:
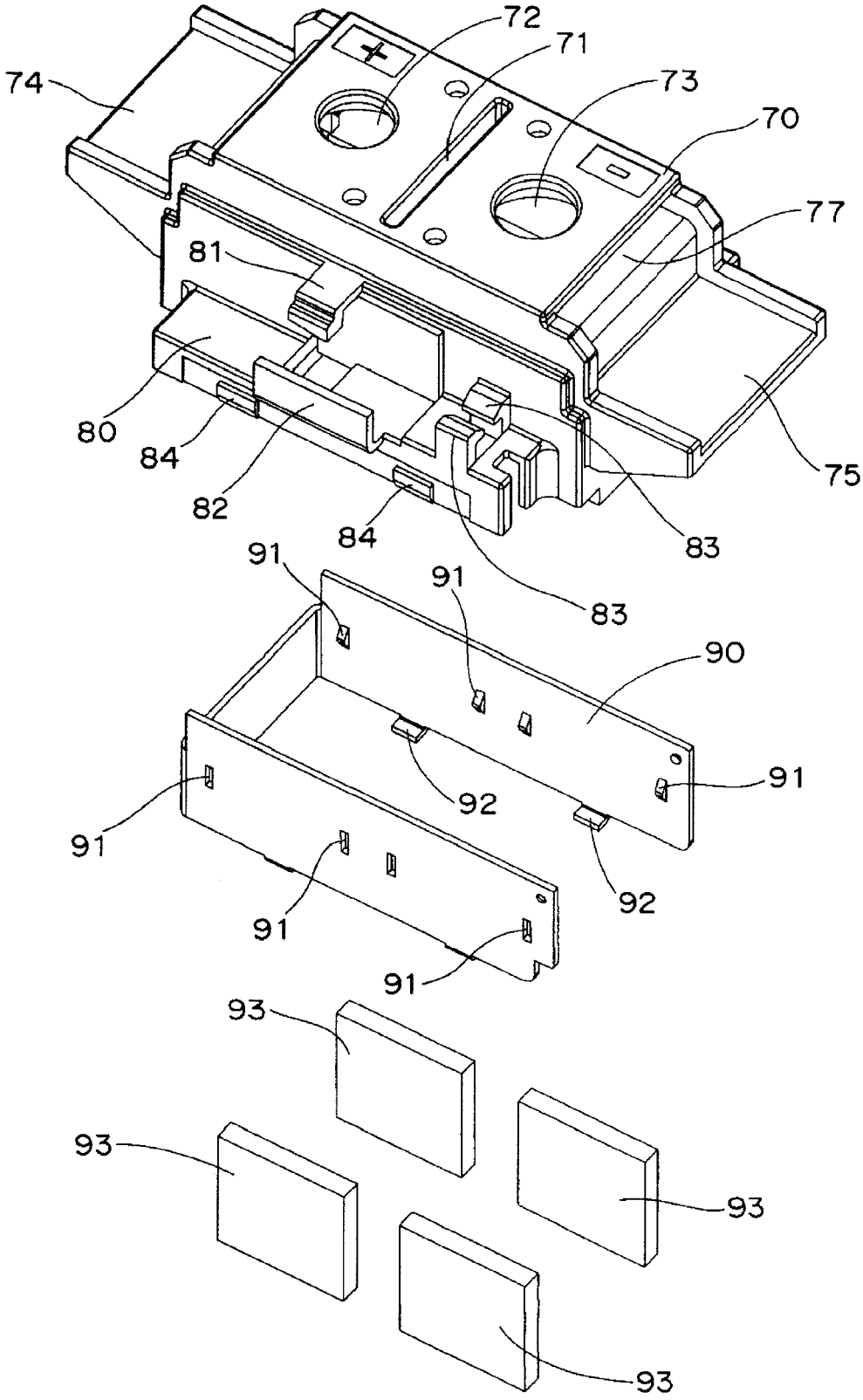
FIG. 12 is an exploded perspective view of a cover shown in FIG. 4.

As shown in FIG. 12, the cover 70 has a plan shape that can be fitted to the case 10. The cover 70 is fitted at the inner side surface with a holding member 90 made of magnetic material having a substantially horseshoe-shape in plan view.

As shown in FIG. 4, the cover 70 has terminal holes 72, 73 formed on both sides of an insulation deep grove portion 71, which is formed at the middle of the roof surface. The cover 70 also has receiving portions 74, 75 arranged projecting to the side from the side surfaces on both sides of the short side. Insertion slits 76, 77 enabling external connection terminals 95, 96 to be inserted are formed at the base of the receiving portions 74, 75. The external connection terminals 95, 96 bent through press working have stud bolts 95*a*, 96*a*, which can be screw-fit to connection nuts 97, 98, implanted at one end side.

The cover 70 has steps 80, 80 arranged projecting towards the side at the side surfaces on both sides of the long side, and an elastic arm 81 for preventing a connector 100, to be hereinafter described, from coming out arranged in a projecting manner at the side surface on one side. The step 80 positioned on the lower side of the elastic arm 81 has a guide wall 82 arranged in a projecting manner at the outer side edge, and a pair of position regulating nails 83, 83 arranged in a projecting manner at the end of the upper surface.

As shown in FIG. 12, the holding member 90 has positioning projections 91 arranged in a projecting matter at a predetermined pitch on the opposing inner side surfaces, and a positioning nail 92 raised from the edge on the lower side. Two sets, each set including two magnets 93, are arranged facing each other by way of the positioning projections 91 and the nails 92. The magnet 93 pulls the arc generated between the movable contact 63 and the fixed contact terminals 52, 53 with the magnetic force and allows the arc to be easily extinguished.

As shown in FIG. 4, the connector 100 attached to the cover 70 is connected to the lead wire 33*a* connected to the relay terminal 33. The connector 100 is placed on the step 80 of the cover 70, and is slid along the guide wall 82 so that the elastic arm 81 locks to an elastic tongue piece 101 of the connector 100 and prevents it from slipping out (FIG. 1B). Furthermore, the lead wire 33*a* engages the pair of position regulating nails 83, 83 to be position regulated.

A method of assembling the seal contact device according to the present embodiment will now be described.

First, the electromagnet block 30 in which the coil 32 is wound around the spool 31 is placed and positioned at the first yoke 21. The shield member 55 is positioned at the middle of the upper surface of the second yoke 22 caulked and fixed with the fixed iron core 40 in advance, and the drive shaft 61 of the movable contact block 60 is inserted to the pass-through hole 56*a* of the shield member 55 and the shaft hole of the fixed iron core 40. The inner peripheral edge of the sealed container 51 brazed with the fixed contact terminals 52, 53 and the annular skirt portion 54 is fitted to the shield ring 57 of the shield member 55. The annular skirt portion 54 is laser welded and integrated to the upper surface of the second yoke 22 while pushing the box-shaped molded article 56 with the lower end face of the opening edge of the sealed container 51.

The drive shaft 61 projecting out from the lower surface of the fixed iron core 40 is then inserted to the returning coil spring 41 and the shaft hole of the movable iron core 42. The movable iron core 42 is pushed in against the spring force of the returning coil spring 41 until contacting the fixed iron core 40. Furthermore, the drive shaft 61 is pushed in until obtaining a predetermined contact pressure, a state in which the movable contact 63 contacts the fixed contact terminals 52, 53 with a predetermined contact pressure is maintained, and the lower end of the drive shaft 61 is welded and integrated to the movable iron core 42. Thereafter, the shock eliminating circular plate 48 made of rubber is attached to the recessed portion formed at the bottom surface of the movable iron core 42. Then, the bottomed tubular body 34 accommodating the adhesion prevention metal sheet 49 is placed over the movable iron core 42 and the shock eliminating circular plate 48 made of rubber, and the opening edge thereof is welded and integrated through laser welding to the lower surface of the second yoke 22. After releasing the air in the sealed space from the gas sealing pipe 23, inactive gas is injected, and the gas sealing pipe 23 is caulked and sealed.

Furthermore, the bottomed tubular body 34 is inserted to the center hole 31*c* of the spool 31, and both ends of the second yoke 22 are fitted to and fixed to the cutouts 21*b* of the first yoke 22. The annular auxiliary yoke 35 is fitted to the lower end of the bottomed tubular body 34 projecting out from the insertion hole 21*a* of the first yoke 21, and prevented from coming out with the O-ring 36.

The drive mechanism unit 20 and the contact mechanism unit 50 integrated one above the other are then inserted into the base 10, the lower end of the projecting bottomed tubular body 34 is fitted to and positioned in the recessed portion 11 of the base 10, and the lead wire 33*a* is pulled out from the cutout 16 (FIG. 4). The engagement nail 84 of the cover 70 is then engaged and fixed to the engagement hole 15 of the base 10. The external connection terminals 95, 96 are inserted to the insertion slits 76, 77 of the cover 70 from the side, and screws 99*a*, 99*b* are screwed into the screw holes 52*a*, 53*a* of the fixed contact terminals 52, 53 to thereby fix the external connection terminals 95, 96.

Figure 1A:
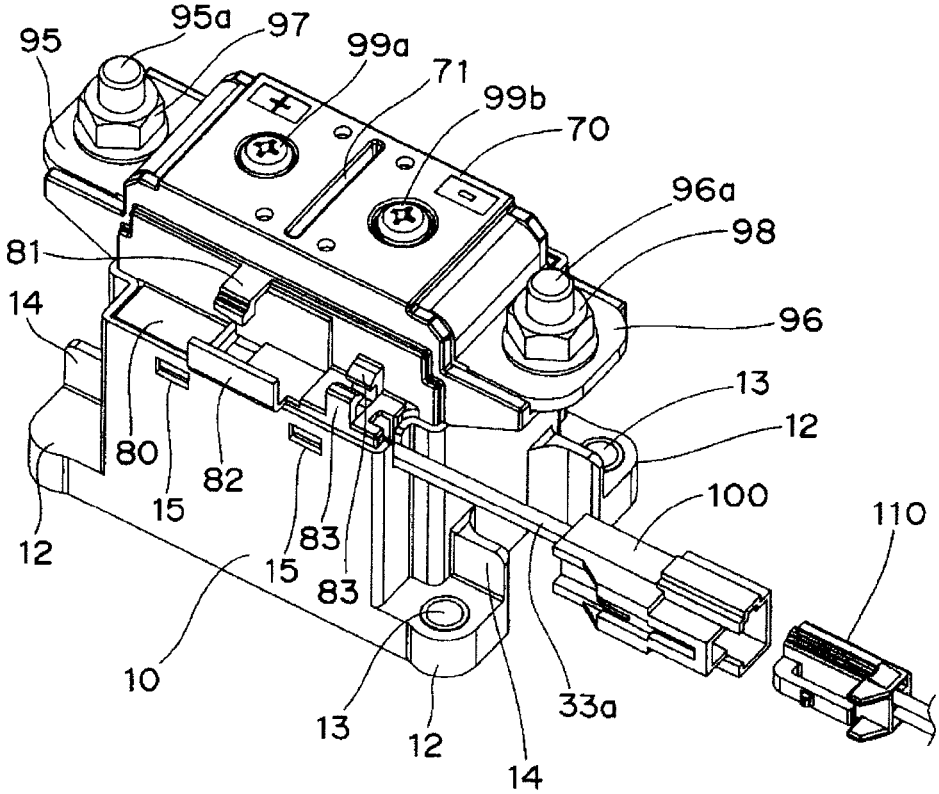
FIGS. 1A and 1B are perspective views each showing a first embodiment of a power load electromagnetic relay applied with a contact device according to the present invention.
Figure 1B:
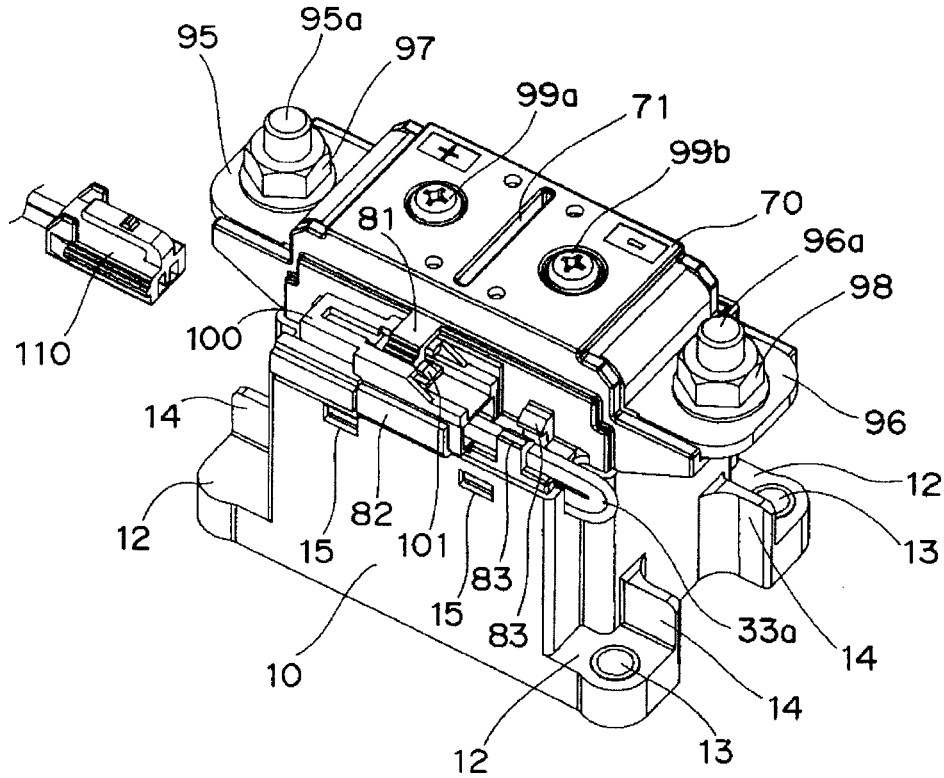

As shown in FIGS. 1A and 1B, the lead wire 33*a* pulled out from the base 10 is bent and the connector 100 is slid along the guide wall 82 arranged at the step 80, so that the elastic arm 81 locks to the elastic nail 101 of the connector 100 to prevent it from coming out. Finally, the lead wire 33*a* is locked to the elastic nail 83, 83 and is position regulated. The power load electromagnetic relay according to the present embodiment is thereby obtained.

The operation of the contact device according to the present embodiment will now be described.

Figure 2:
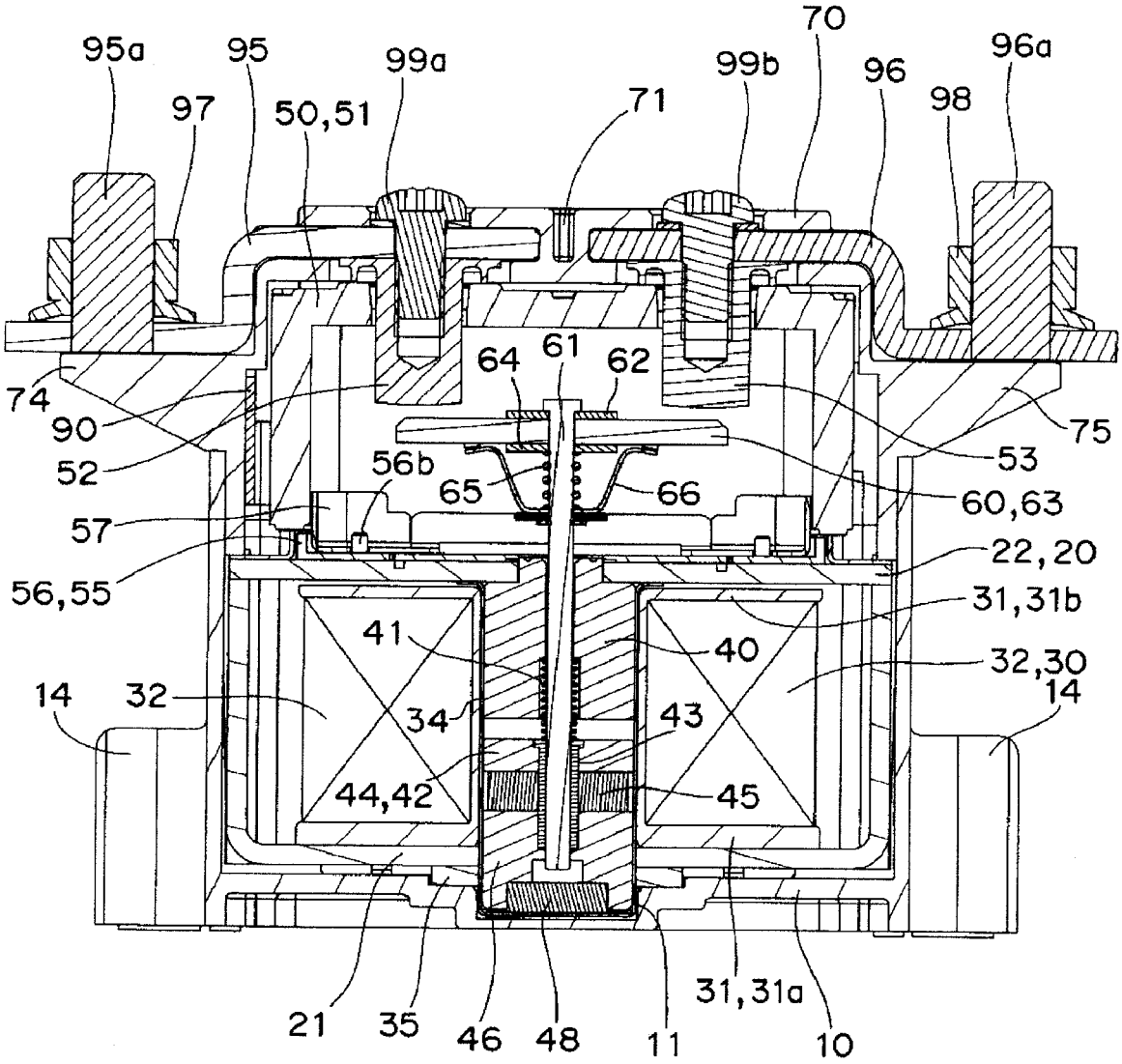
FIG. 2 is a front cross-sectional view of the contact device shown in FIGS. 1A and 1B.
Figure 3:
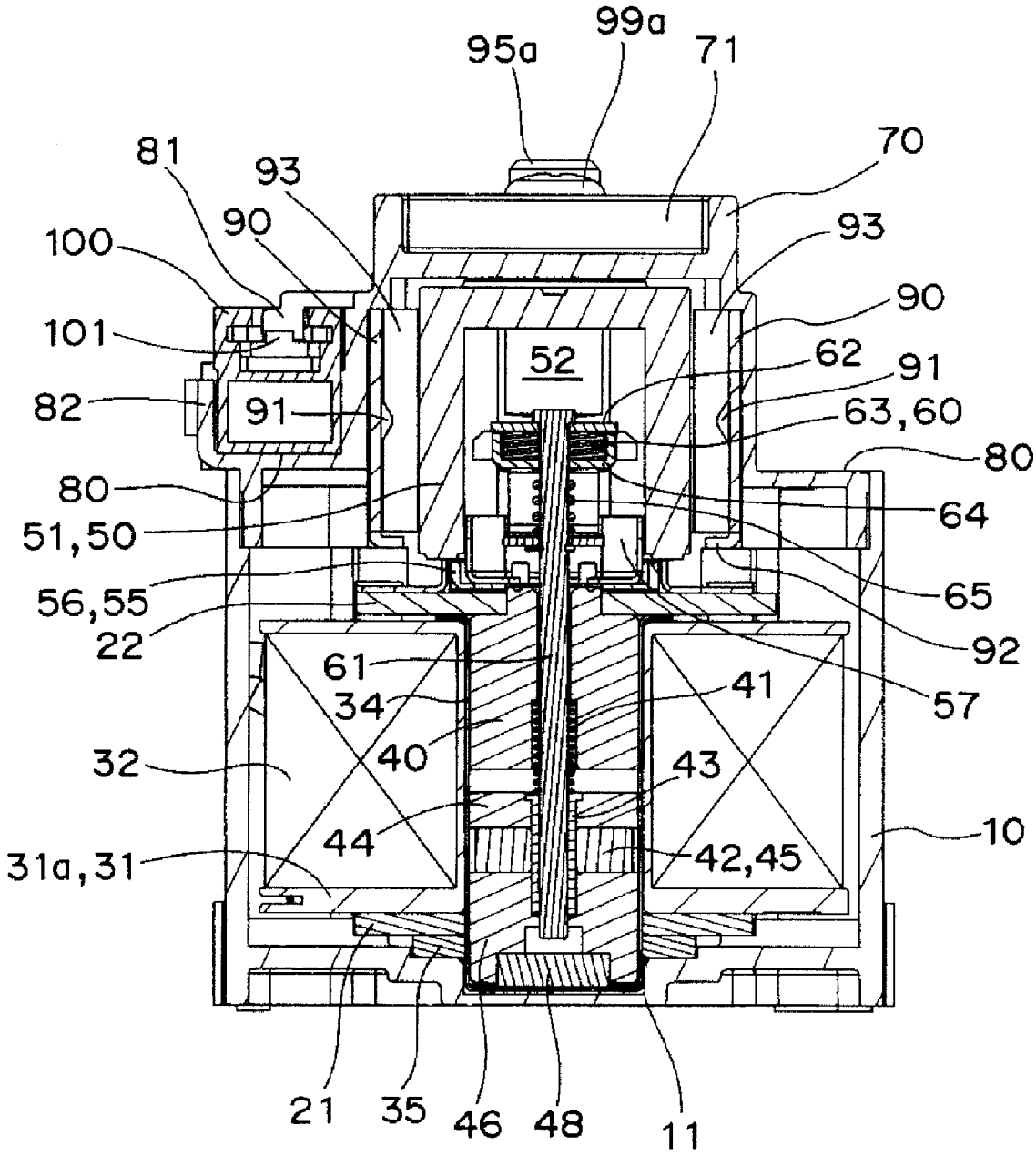
FIG. 3 is a side cross-sectional view of the contact device shown in FIGS. 1A and 1B.

As shown in FIG. 2, when voltage is not applied to the coil 32, the movable iron core 42 is separated from the fixed iron core 40 by the spring force of the returning coil spring 41 and the magnetic force of the permanent magnet 45 of the movable iron core 42. Thus, both ends of the movable contact 63 are separated from the lower ends of the fixed contact terminals 52, 53.

Figure 13:
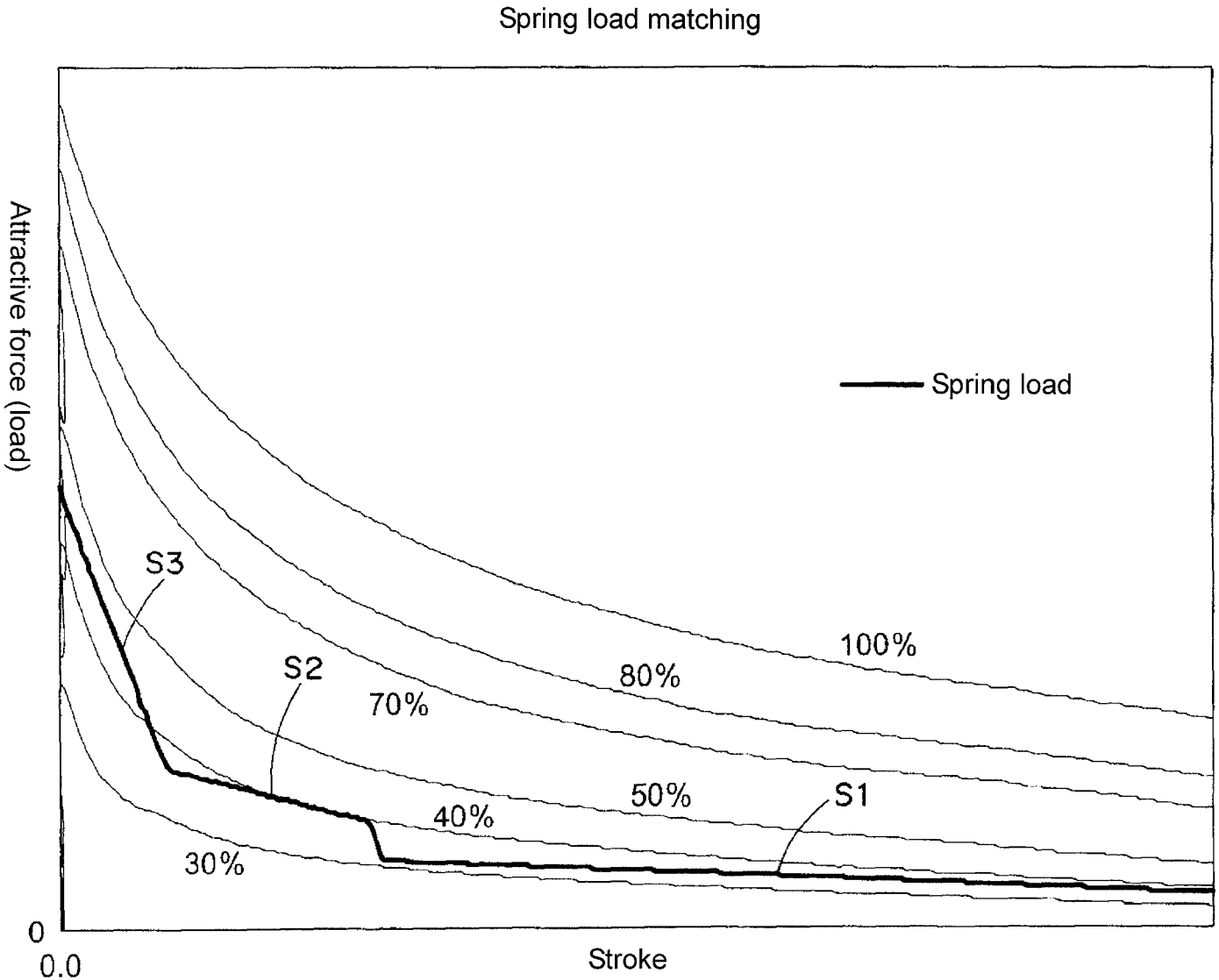
FIG. 13 is a graph showing attractive force characteristics of the contact device according to the first embodiment.

When voltage is applied to the coil 32, the fixed iron core 40 attracts the movable iron core 42, and the movable iron core 42 moves towards the fixed iron core 40 against the spring force of the returning coil spring 41 (first stage S1), as shown in FIG. 13. Thus, the drive shaft 61 integral with the movable iron core 42 moves in the axis center direction, and both ends of the movable contact 63 contact the lower ends of the fixed contact terminals 52, 53. In this case, large current flows to the movable contact 63, and repulsive force arises between the movable contact 63 and the fixed contact terminals 52, 53. However, since the magnetic force simultaneously arises between the first electromagnetic iron piece 62 and the second electromagnetic iron piece 64 and attract each other, the operation of the movable contact 63 moving away from the fixed contact terminals 52, 53 is regulated, and the contact welding due to generation of the arc is prevented.

The movable iron core 42 is attracted towards the fixed iron core 40, the movable iron core 42 moves against the spring force of the returning coil spring 41 and the contact-pressure coil spring 65, and the contact pressure increases (second stage S2). The movable contact 63 then contacts the lower ends of the fixed contact terminals 52, 53 with a predetermined pressure against the spring force of the returning coil spring 41, the contact-pressure coil spring 65, and the contact-pressure plate spring 66 (third stage S3), and thereafter, the movable iron core 61 is attracted to the fixed iron core 40, and such a state is maintained.

When application of voltage on the coil 32 is stopped, the magnetic force disappears, and the movable iron core 42 separates from the fixed iron core 40 by the spring force of the returning coil spring 41. Then, the movable iron core 42 returns to the original position after the movable contact 63 separates from the fixed contact terminals 52, 53. In returning, the shock eliminating circular plate 48 attached to the recessed portion at the bottom surface of the movable iron core 42 impacts the adhesion prevention metal sheet 49, but the shock eliminating circular plate 48 absorbs and alleviates the impact force.

According to the present embodiment, two types of contact-pressure coil spring 65 and plate spring 66 are combined. Thus, the spring load changes in multi-stages and can more easily comply with the attractive force characteristics curve, as shown in FIG. 13, whereby the design is facilitated and the degree of freedom of design is extended.

In the present embodiment, a case where the auxiliary yoke 35 is circular in plane has been described, but may be square in plane.

A case where the annular auxiliary yoke 35 is prevented from coming out with the O-ring 36 has been described, but is not necessarily limited thereto, and may be fixed to the bottomed tubular body 34 through spot welding.

The present embodiment has been described for the case applied to the power load electromagnetic relay, but the present embodiment is not limited thereto, and may obviously be applied to other electric devices.

What is claimed is:

1. An electromagnetic relay comprising:

a movable contact arranged at one end of a drive shaft that reciprocates in an axis center direction based on excitation and demagnetization of an electromagnet block, wherein the drive shaft is a single piece; and a pair of adjacently arranged fixed contacts with which the movable contact is operable to contact and separate, wherein a first electromagnetic iron piece, a second electromagnetic iron piece and the movable contact are inserted to the drive shaft so that the first electromagnetic iron piece and the second electromagnetic iron piece sandwich the movable contact, wherein the second electromagnetic iron piece is biased to one end side of the drive shaft with a coil spring inserted to the drive shaft, and wherein when the movable contact contacts to the pair of fixed contacts, the second electromagnetic iron piece forming a magnetic circuit with the first electromagnetic iron piece pushes the movable contact to the pair of fixed contacts.

2. The electromagnetic relay according to claim 1, wherein an upper end face of the second electromagnetic iron piece, which reciprocates, having a substantially U-shaped cross section contact and separate to and from a lower surface of the first electromagnetic iron piece of plate-shape.

3. The electromagnetic relay according to claim 1, wherein both ends of the first electromagnetic iron piece slidably contact opposing inner side surfaces of the second electromagnetic iron piece, which reciprocates, having a substantially U-shaped cross section.

4. The electromagnetic relay according to claim 1, wherein both the first and the second electromagnetic iron pieces have a substantially L-shaped cross section, a distal end face of a bent portion of one electromagnetic iron piece contacting and separating a flat surface of the other electromagnetic iron piece.

5. The electromagnetic relay according to claim 1, wherein both the first and the second electromagnetic iron pieces have a substantially U-shaped cross section, distal end faces of bent portions contacting and separating each other.

6. The electromagnetic relay according to claim 4, wherein the distal end faces of the first and the second electromagnetic iron pieces having a substantially U-shaped cross section have a tapered surface that contact and separate to and from each other.

7. The electromagnetic relay according to claim 5, wherein the distal end faces of the first and the second electromagnetic iron pieces having a substantially U-shaped cross section have a tapered surface that contact and separate to and from each other.

8. The electromagnetic relay according to claim 1, wherein the drive shaft is solid.

9. The electromagnetic relay according to claim 1, wherein the drive shaft has a substantially T-shaped cross-section.

10. The electromagnetic relay according to claim 8, wherein the drive shaft has a substantially T-shaped cross-section.

* * * * *